US006808416B2

(12) United States Patent
Fegley et al.

(10) Patent No.: US 6,808,416 B2
(45) Date of Patent: Oct. 26, 2004

(54) COAXIAL CABLE CONNECTOR

(75) Inventors: Jeffrey J. Fegley, Camp Hill, PA (US); James English, Bainbridge, PA (US); James Fetterolf, Sr., Mechanicsburg, PA (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 10/116,242

(22) Filed: Apr. 4, 2002

(65) Prior Publication Data

US 2003/0190840 A1 Oct. 9, 2003

(51) Int. Cl.[7] ..... H01R 9/05
(52) U.S. Cl. ..... 439/585; 439/877
(58) Field of Search ..... 439/578–585, 439/675, 877

(56) References Cited

U.S. PATENT DOCUMENTS

| | | | | | |
|---|---|---|---|---|---|
| 3,297,979 | A | * | 1/1967 | O'Keefe et al. | 439/585 |
| 3,355,698 | A | | 11/1967 | Keller | 439/585 |
| 3,363,222 | A | * | 1/1968 | Karol | 439/581 |
| 3,539,709 | A | * | 11/1970 | Brancaleone | 174/75 C |
| 4,746,305 | A | * | 5/1988 | Nomura | 439/319 |
| 4,772,222 | A | * | 9/1988 | Laudig et al. | 439/578 |
| 4,966,560 | A | * | 10/1990 | Marzouk | 439/585 |
| 4,990,106 | A | | 2/1991 | Szegda | 439/585 |
| 5,073,129 | A | | 12/1991 | Szegda | 439/585 |
| 5,113,474 | A | | 5/1992 | Slaney et al. | 385/136 |
| 5,141,451 | A | | 8/1992 | Down | 439/585 |
| 5,338,225 | A | | 8/1994 | Jacobsen et al. | 439/585 |
| 5,499,934 | A | | 3/1996 | Jacobsen et al. | 439/585 |
| 5,525,076 | A | | 6/1996 | Down | 439/585 |
| 5,860,833 | A | | 1/1999 | Chillscyzn et al. | 439/585 |
| 6,471,545 | B1 | * | 10/2002 | Hosler, Sr. | 439/585 |

* cited by examiner

*Primary Examiner*—Hien Vu
(74) *Attorney, Agent, or Firm*—Barley, Snyder, Senft & Cohen, LLC

(57) ABSTRACT

The invention relates to a coaxial cable connector having a conductive outer shell comprising a mating section and a cylindrical sleeve. The cylindrical sleeve has a cable receiving end having an annular projection with a larger external diameter than the cylindrical sleeve. A coaxial cable is stripped to expose portions of an outer conductor, a dielectric, and a central conductor. The central conductor terminates within a signal pin. A ferrule is positioned over the outer conductor. The outer conductor is folded back over the ferrule. An insulative cylinder is positioned over the dielectric. When a crimping die is applied to the cylindrical sleeve, the crimping die first contacts the annular projection. The annular projection rolls inward and toward the mating section of the conductive outer shell. The annular projection contacts the ferrule pushing the ferrule toward the mating section to create a forward bias inside the cylindrical sleeve.

13 Claims, 3 Drawing Sheets

COAXIAL CABLE CONNECTOR

FIELD OF THE INVENTION

The present invention relates to coaxial cable connectors and, more particularly, to a coaxial connector having an improved crimp section.

BACKGROUND OF THE INVENTION

Coaxial cable connectors are commonly used to terminate coaxial cables. These connectors typically include a conductive outer shell comprising a mating section, a signal pin and a cylindrical sleeve that receives and mechanically secures a stripped end of a coaxial cable. The coaxial cable has a center conductor for transmitting a signal. The center conductor is surrounded by a dielectric. An outer ground or shield conductor in the form of a pliant wire braid encircles the dielectric. The outer conductor is encased in a protective jacket.

To secure the coaxial cable in the connector, a stripped end of the coaxial cable is inserted into a receiving end of the cylindrical sleeve. The exposed center conductor is electrically connected to the signal pin contained within the connector. As the coaxial cable is inserted into the cylindrical sleeve, an inner tubular member, that may comprise raised barbs, is forced between the dielectric and the outer conductor of the coaxial cable. The outer conductor is received in a space between the cylindrical sleeve and the inner tubular member and may be folded back over the end of the protective jacket. This method and arrangement is disclosed in U.S. Pat. No. 5,499,934 issued to Jacobsen et al. and U.S. Pat. No. 5,525,076 issued to Down. A conventional crimping tool is then used to apply a crimp to the outside of the cylindrical sleeve securing the outer conductor jacket of the coaxial cable between the inner tubular member and the cylindrical sleeve.

A known alternative method for securing a coaxial cable in a connector is commonly used when larger connectors terminate smaller coaxial cables. In this method, a ferrule and an insulative cylinder, respectively, are positioned over the stripped coaxial cable before insertion into the cylindrical sleeve. The exposed center conductor is electrically connected to the signal pin within the connector. The outer conductor of the coaxial cable is then folded back and over the ferrule so that the outer conductor is received in a space between the cylindrical sleeve and the ferrule when the coaxial cable is inserted into the cylindrical sleeve. A conventional crimping tool is then used to apply a crimp along the outside diameter of the cylindrical sleeve to secure the outer conductor jacket of the coaxial cable between the ferrule and the cylindrical sleeve.

In these connectors, a compressive force applied by the crimp secures the internal components of the connector. This retention alone, however, is inadequate when external pulling forces are applied to the coaxial cable. For example, when an external force is exerted on the coaxial cable in a direction opposite from the connector body, the compressive forces are unable to prevent outward movement of the internal components. When the internal components become displaced, the integrity of the connector is jeopardized. Gaps created between the internal components also allow moisture and other foreign matter to enter the connector and may result in pin stubbing upon mating, further deteriorating the electrical performance of the connector.

It is therefore desirable to develop a coaxial connector with a rigid construction that improves coaxial cable retention and electrical performance by providing additional physical restraint of the internal components of the coaxial connector.

SUMMARY OF THE INVENTION

An object of the present invention is to develop an improved crimp section for a coaxial cable connector. This and other objects of the invention are achieved by a coaxial connector having a conductive outer shell comprising a mating section and a cylindrical sleeve. The cylindrical sleeve has a cable receiving end for receiving a cable, at least one ferrule located inside the cylindrical sleeve and an annular projection positioned on the cable receiving end of the cylindrical sleeve. The annular projection has a larger external diameter than the cylindrical sleeve. When a crimping die is applied to the cylindrical sleeve, the crimping die first contacts the annular projection, causing the annular projection to roll inward and toward the -mating section of the conductive outer shell to securely forward bias the cable and ferrule within the cylindrical sleeve.

BRIEF DESCRIPTION OF THE DRAWINGS

The invention will now be described by way of example with reference to the accompanying figures in which.

DETAILED DESCRIPTION OF THE PREFERRED EMBODIMENTS

Figure 1:
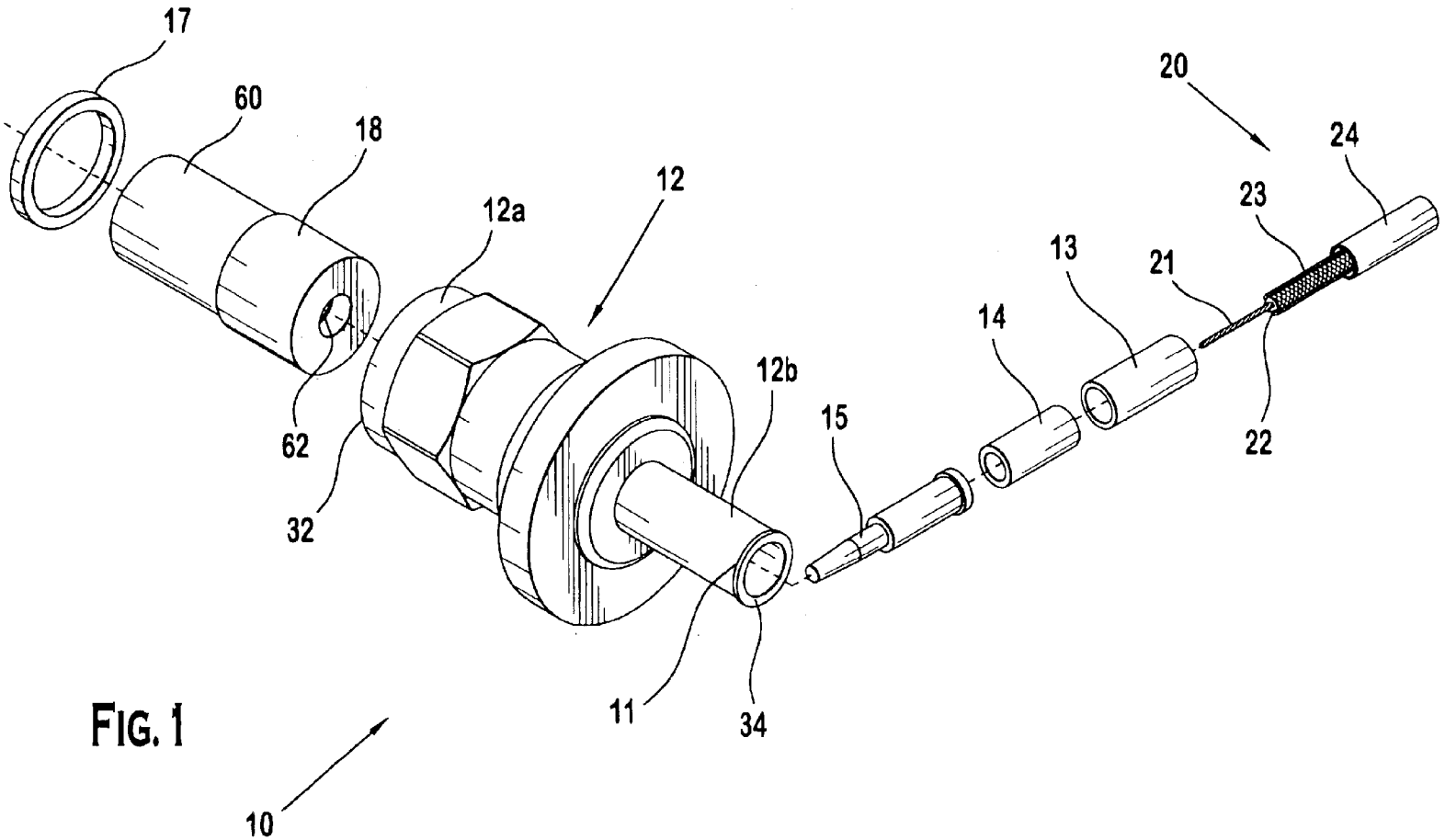
FIG. 1 is an exploded perspective view of the coaxial connector.

FIG. 1 shows a coaxial cable connector 10 having an electrically conductive outer shell 12 comprising a mating section 12*a* and a cylindrical sleeve 12*b*. The mating section 12*a* has a centrally located signal pin 15 surrounded by a dielectric 18. A retaining ring 17 is positioned between the outer shell 12 and the dielectric 18. The mating section 12*a* may optionally comprise a fastener (not shown) that surrounds the conductive outer shell 12, such as an internally threaded nut, designed to secure a complimentary receptacle to the mating section 12*a* of the end connector 10. The cylindrical sleeve 12*b* has a cable receiving end 34 and an annular projection 11. The cylindrical sleeve 12*b* receives a coaxial cable 20 for termination within the connector 10. The coaxial cable 20, shown in FIG. 1, has a center conductor 21 for transmitting a signal. The center conductor 21 is a solid or stranded wire that is centrally located within a dielectric 22. An outer conductor 23 or shield surrounds the dielectric 22. The outer conductor 23 generally comprises a pliant wire braid that may be woven over a foil sheath. The outer conductor 23, encircling the cylindrical dielectric 22, is encased within a protective jacket 24.

Figure 2:
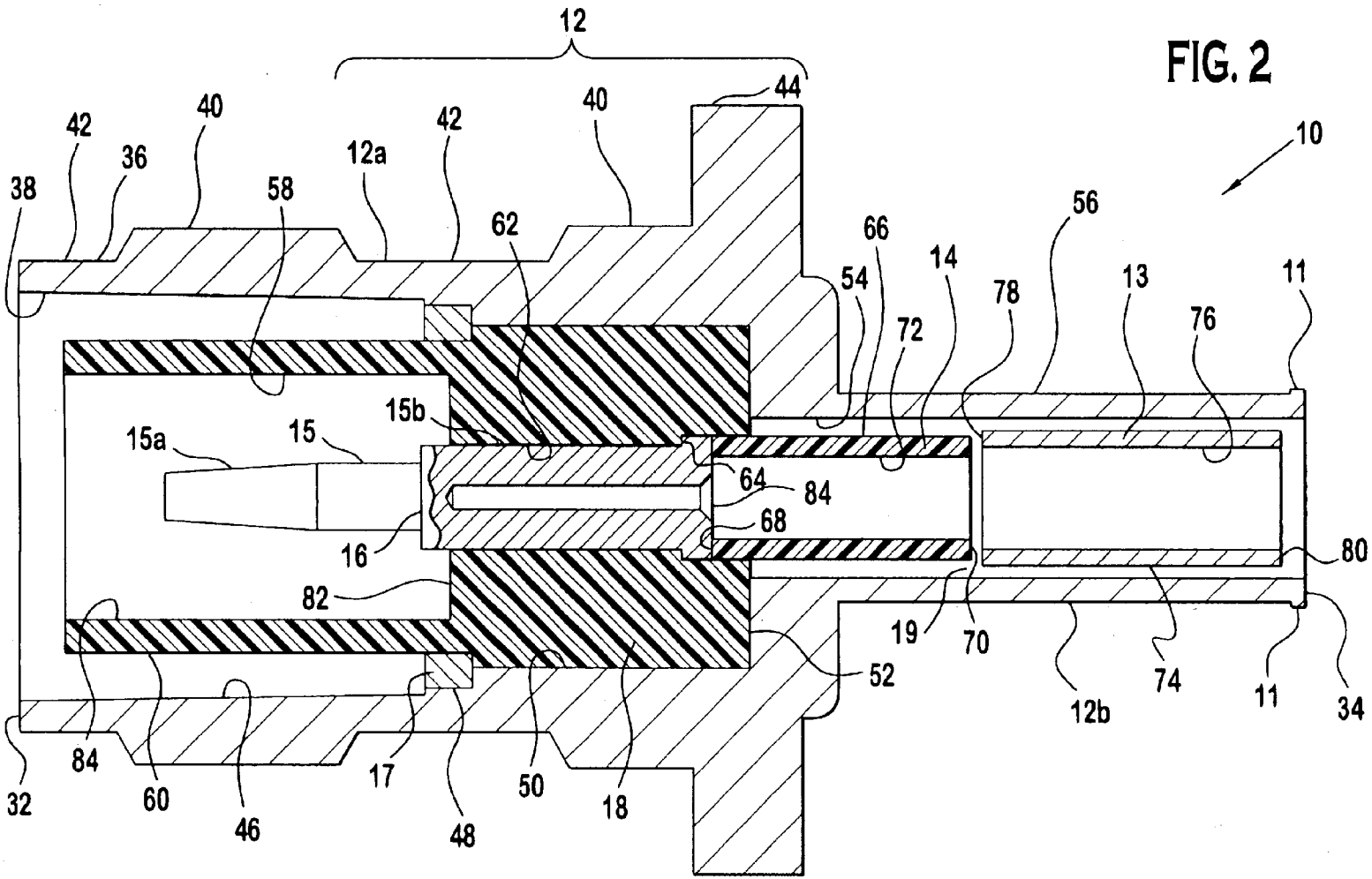
FIG. 2 is a cross-sectional view of the coaxial connector before cable insertion and crimping.

Each of the major components will now be described in greater detail with reference to FIGS. 1 and 2. As shown in FIG. 2, the conductive outer shell 12 has a mating end 32 and a cable receiving end 34 disposed opposite the mating end 32. An outer surface 36 extends from the mating end 32 to the cable receiving end 34. The conductive outer shell 12 consists mainly of a mating section 12*a* and a cylindrical sleeve 12*b*. Within the mating section 12*a*, the outer surface 36 is contoured to have raised portions 40 and recessed portions 42 disposed therebetween. Moving rearward from the mating section 12*a*, an annular ridge 44 is disposed about the outer surface 36 rearward of the raised portion 40.

The cylindrical sleeve 12*b* is disposed between the annular ridge 44 and the cable receiving end 34. The cylindrical sleeve 12*b* consists of a generally tubular section having a cylindrical sleeve inner surface 54 and a cylindrical sleeve outer surface 56. An annular projection 11 is disposed around the cylindrical sleeve outer surface 56 at the cable receiving end 34. It should be understood by those reasonably skilled in the art that while the annular projection 11 is shown here as having a generally rectangular cross section it could have other geometrical configurations either on the outer surface 56 or the inner surface 54 that may have a similar function as will be described in greater detail below. Also, it should be understood by those reasonably skilled in the art that while the outer surface 36 has been described with a certain contour, that contour may be varied depending on size constraints and securing requirements of a particular application.

Beginning once again at the mating end 32 in FIG. 2, the conductive outer shell 12 has a receptacle receiving portion 46 disposed along an inner surface 38. The inner surface 38 extends from the mating end 32 to the cable receiving end 34. A ring receiving portion 48 is located along the inner surface 38 rearward of receptacle receiving portion 46 and has a slightly smaller inner diameter than the receptacle receiving portion 46. A dielectric receiving portion 50 is located rear of the ring receiving portion 48 and has a slightly smaller diameter than the ring receiving portion 48. The dielectric receiving portion 50 ends at a rear wall 52 that connects with a cylindrical sleeve inner surface 54. The cylindrical sleeve inner surface 54 is generally cylindrical and has a relatively smaller diameter than the dielectric receiving portion 50. The cylindrical sleeve inner surface 54 extends from the rear wall 52 back to the cable receiving end 34.

A dielectric 18 is located within the dielectric receiving portion 50 at the mating end 32 of the connector 10 and has a diameter smaller than the inner surface 38. The dielectric 18 extends to the rear wall 52 and has a receptacle guide 60 that forms an inner receptacle receiving portion 58. A signal pin receiving portion 62 extends through the dielectric 18 and extends to an insulative cylinder receiving portion 84. Located on the signal pin receiving portion 62 is an annular stop wall 64 that transitions to the larger circumferencial area of the insulative cylinder receiving portion 84.

The signal pin 15 is centrally located within the inner receptacle receiving portion 58. The signal pin 15 has a coupling portion 15*a* and a signal pin body 15*b*. The coupling portion 15*a* of the signal pin 15 extends to a wall 16 of the signal pin body 15*b*. The signal pin body 15*b* is hollow and has a larger diameter than the coupling portion 15*a*.

An insulative cylinder 14 has an insulative cylinder inner surface 72; and an insulative cylinder outer surface 66 that extends between first and second ends 68, 70. The insulative cylinder inner surface 72 has a diameter smaller than the diameter of the insulative cylinder outer surface 66. The diameter of the insulative cylinder outer surface 66 is smaller than the cylindrical sleeve inner surface 54 such that a small clearance exists between the insulative cylinder outer surface 66 and the cylindrical sleeve inner surface 54. The insulative cylinder first end 68 is positioned adjacent to the signal pin body 15*b*. The insulative cylinder second end 70 is positioned adjacent a conductive ferrule 13.

The ferrule 13 is generally cylindrical and has a ferrule outer surface 74 and a ferrule inner surface 76, that extends between first and second ends 78, 80. The ferrule inner surface 76 has a diameter smaller than the ferrule outer surface 74, but larger than the insulative cylinder inner surface 72. The ferrule outer surface 74 has a diameter smaller than the inner diameter of the cylindrical sleeve inner surface 54, but slightly larger than the insulative cylinder outer surface 66 such that the clearance 19 between the ferrule outer surface 74 and the cylindrical sleeve inner surface 54 is slightly smaller than between the insulative cylinder 14 and the inner diameter 54. The ferrule first end 78 is positioned adjacent to the insulative cylinder second end 70 and extends to the cable receiving end 34 such that the ferrule second end 80 is positioned slightly forward within the annular projection 11 near the cable receiving end 34.

Termination of the coaxial cable 20 and assembly of the connector 10 will now be described in greater detail with reference to FIGS. 1 and 3. First the dielectric 18 is loaded into the mating section 12*a* from the mating end 32 until it engages the rear wall 52. The retaining ring 17 is secured in the receiving portion 48 to retain the dielectric 60.

To prepare the coaxial cable 20 for installation in the connector 10, a conventional tool is used to strip one end of the coaxial cable 20 as best shown in FIG. 1. The protective jacket 24 of the coaxial cable 20 is removed to expose the outer conductor 23. A portion of the outer conductor 23 and a smaller portion of the dielectric 22 are stripped away to expose the center conductor 21.

The ferrule 13 is positioned over the protective jacket 24 behind the exposed outer conductor 23. The outer conductor 23 is then folded back over the ferrule 13 as best shown in FIG. 3. The insulative cylinder 14 is positioned over the section of the coaxial cable its dielectric 22 exposed therebehind. The center conductor 21 is received in the signal pin body 15*b* and terminates behind the wall 16. Termination of the center conductor 21 to the signal pin 15 may be accomplished by crimping or other suitable means. The terminated signal pin 15, insulative cylinder 14, ferrule 13 and cable 20 subassembly is then inserted into the conductive outer shell 12 from the cable receiving end 34 until the pin body 15*b* engages the annular stop wall 64. The outer conductor 23 is received in a clearance 19 between the ferrule 13 and the inner surface 54.

Figure 3:
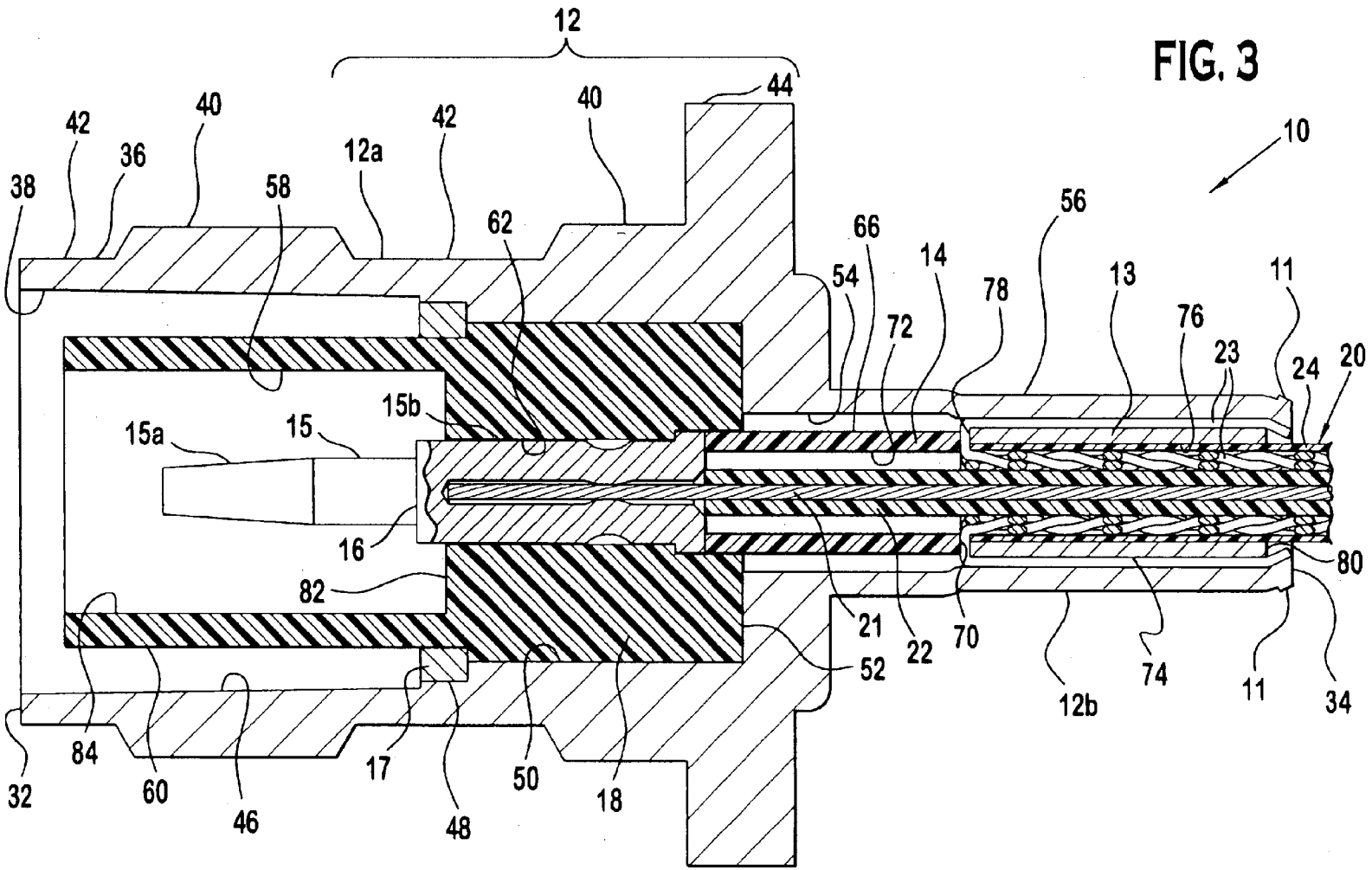
FIG. 3 is a cross-sectional view of the coaxial connector including a terminated cable.

A conventional crimping die, such as a hex die (not shown) is then applied to the cylindrical sleeve 12*b* to secure the coaxial cable 20 inside the connector 10 as best shown in FIG. 3. Because the annular projection 11 at the rear of the cylindrical sleeve 12*b* has a larger external diameter compared to the balance of the cylindrical sleeve 12*b*, as the cylindrical sleeve 12*b* is crimped, the die will first contact the annular projection 11. As the crimp is applied, the annular projection 11 is forced to roll inward and toward the mating end 32 of the conductive outer shell 12. As a result, the cable receiving end 34 of the cylindrical sleeve 12*b* has post crimp diameter which is slightly smaller than the balance of the cylindrical sleeve 12*b*. The internal deformation of the cylindrical sleeve 12*b* behind the ferrule 13 causes the internal components including the ferrule 13, the insulative cylinder 14, and the signal pin 15, to be biased forward. The forward biased internal components, as well as the outer conductor 23 are locked in place by the internal surface of the annular projection 11 at the rear of the cylindrical sleeve 12*b*.

As the die continues to crimp the cylindrical sleeve 12*b*, the cylindrical sleeve 12*b* is compressed to eliminate the clearance 19 between the ferrule 13 and the cylindrical sleeve 12*b*, securing the outer conductor 23 between the ferrule outer surface 74 and the cylindrical sleeve inner surface 54. The major components are advantageously biased and retained in the conductive outer shell 12 by a single crimping action.

While the present invention has been described in connection with the illustrated embodiments, it will be appreciated and understood that modifications may be made without departing from the true spirit and scope of the invention. For example, the annular projection could be positioned on the cylindrical sleeve inner surface and a similar effect may be achieved. It is, therefore, intended that the foregoing description be regarded as illustrative rather than limiting, and that the scope of the invention is given by the appended claims together with their full range of equivalents.

What is claimed is:

1. A coaxial cable connector, comprising:

a conductive outer shell having a mating section and a cylindrical sleeve;

the cylindrical sleeve having a cable receiving end; and an annular projection positioned on the cable receiving end of the cylindrical sleeve and having a larger external diameter than a remainder of the cylindrical sleeve;

wherein when a crimping die is applied to the cylindrical sleeve, the crimping die first contacts the annular projection, causing the annular projection to bend inward into an interior of the cylindrical sleeve so that the annular projection contacts a ferrule having a smaller diameter than a diameter of the cylindrical sleeve and positioned inside the cable receiving end of the cylindrical sleeve over an exposed outer conduct of a coaxial cable to push the ferrule forward and toward the mating section to create a forward bias within the cylindrical sleeve.

2. The coaxial cable connector of claim 1, wherein the outer conductor is folded back over an outer surface of the ferrule.

3. The coaxial cable connector of claim 2, wherein the outer conductor is crimped between the ferrule and the cylindrical sleeve.

4. The coaxial cable connector of claim 1, further comprising an insulative cylinder having a smaller diameter than a diameter of the cylindrical sleeve wherein the insulative cylinder is positioned over an exposed dielectric of a coaxial cable and the insulative cylinder is inserted into the cable receiving end of the cylindrical sleeve forward of the ferrule.

5. The coaxial cable connector of claim 1, wherein the annular projection is positioned on an outer surface of the cable receiving end of the cylindrical sleeve.

6. The coaxial cable connector of claim 1, further comprising a dielectric having a circumference smaller than a circumference of the mating section of the conductive outer shell and positioned within the mating section of the conductive outer shell.

7. The coaxial cable connector of claim 6, wherein the dielectric receives a pin terminated to a center conductor of the coaxial cable.

8. A coaxial cable connector, comprising:

a conductive outer shell having a mating section and a cylindrical sleeve;

the cylindrical sleeve having a cable receiving end;

the mating section having a signal pin surrounded by a dielectric sleeve;

a retaining ring interposed between the conductive outer shell and the dielectric sleeve;

a coaxial cable having a stripped end exposing portions of an outer conductor, a dielectric, and a central conductor;

the signal pin terminated to the central conductor;

a ferrule positioned in the cylindrical sleeve and over the exposed outer conductor and having the outer conductor folded back over the ferrule;

an insulative cylinder positioned over the exposed dielectric; and an annular projection positioned on the cable receiving end of the cylindrical sleeve and having a larger external diameter than the cylindrical sleeve;

wherein when a crimping die is applied to the cylindrical sleeve, the crimping die first contacts the, annular projection, causing the annular projection to bend inward into an interior of the cylindrical sleeve until the annular projection contacts the ferrule pushing the ferrule forward and toward the mating section to create a forward bias within the cylindrical sleeve.

9. The coaxial cable connector of claim 8, wherein the annular projection is positioned on an outer surface of the cable receiving end of the cylindrical sleeve.

10. A coaxial cable connector having a conductive outer shell, the conductive outer shell having a mating section and a tubular cylindrical sleeve, the mating section having a signal pin, the cylindrical sleeve having a cable receiving end and comprising:

an annular projection positioned on the cable receiving end of the cylindrical sleeve and having a larger external diameter than the cylindrical sleeve;

an annular stop wall formed in a dielectric sleeve housing the signal pin; and a ferrule having a smaller diameter than a diameter of the cylindrical sleeve and positioned inside the cable receiving end of the cylindrical sleeve for positioning over an exposed outer conductor of a coaxial cable, the ferrule being biased toward the annular stop wall after crimping of the annular projection;

wherein when a crimping die is applied to the cylindrical sleeve, the crimping die first contacts the annular projection, causing the annular projection to bend inward into an interior of the cylindrical sleeve until the annular projection contacts the ferrule pushing the ferrule forward and toward the annular stop wall to create a forward bias within the cylindrical sleeve.

11. The coaxial cable connector of claim 8, wherein the ferrule is biased toward an annular stop wall formed in the dielectric sleeve.

12. The coaxial cable connector of claim 10, further comprising an insulative cylinder for positioning over an exposed dielectric of the coaxial cable, the insulative cylinder positioned inside the cylindrical sleeve and adjacent to the ferrule.

13. The coaxial cable connector of claim 10, wherein the external diameter of the annular projection is smaller than the cylindrical sleeve after crimping.

* * * * *